United States Patent [19]

Rusconi et al.

[11] Patent Number: 4,648,338

[45] Date of Patent: Mar. 10, 1987

[54] AUTOMATIC BOBBIN AND BOBBIN CARRIER CHANGING APPARATUS FOR SEWING MACHINE

[75] Inventors: John B. Rusconi, Milpitas; Ronald A. Cole, San Jose, both of Calif.

[73] Assignee: Max Kahn Curtain Corporation, New York, N.Y.

[21] Appl. No.: 752,894

[22] Filed: Jul. 8, 1985

[51] Int. Cl.[4] ..... D05B 57/26; D05B 19/00

[52] U.S. Cl. ..... 112/180; 112/121.11

[58] Field of Search ..... 112/121.11, 180, 181, 112/186, DIG. 3

[56] References Cited

U.S. PATENT DOCUMENTS

| | | | |
|---|---|---|---|
| 3,376,838 | 4/1968 | Schiffmacher et al. | 112/186 |
| 3,747,547 | 7/1973 | Mayer et al. | 112/186 |
| 3,981,256 | 9/1976 | Sexton | 112/180 |
| 4,223,618 | 9/1980 | Cislak | 112/186 |

FOREIGN PATENT DOCUMENTS

| | | | |
|---|---|---|---|
| 59-49828 | 12/1984 | Japan | 112/180 |
| 59-49829 | 12/1984 | Japan | 112/180 |

*Primary Examiner*—Wm. Carter Reynolds

*Attorney, Agent, or Firm*—Kenyon & Kenyon

[57] ABSTRACT

An apparatus for changing bobbins and bobbin carriers in a sewing machine utilizes a magazine having an opening, containing a bobbin carrier, aligned between the bobbin housing and an electromagnet which pushes the bobbin carrier through the opening into the bobbin housing and then withdraws. The magazine withdraws; the electromagnet moves adjacent the bobbin housing, and in withdrawing pulls a spent bobbin carrier therefrom and drops it. The magazine moves into alignment again between the bobbin housing and the electromagnet, and the cycle repeats. A computer, responsive to apparatus positions, regulates pneumatic valves and an electrical source to automatically effect operations.

13 Claims, 17 Drawing Figures

AUTOMATIC BOBBIN AND BOBBIN CARRIER CHANGING APPARATUS FOR SEWING MACHINE

BACKGROUND OF THE INVENTION

The present invention relates generally to sewing machines, and more particularly to apparatus for automatically changing therein bobbins and bobbin carriers.

Materials are preferably sewn utilizing lockstitch sewing machines; since, the stitch generated by such a machine is continuously locked, and, accordingly, a small break in the thread will not engender unraveling of the stitch. Due to the nature of this machine, the length of continuous stitch which can be produced is limited by the size of the spool in the bobbin. Because the bobbin of necessity must be fairly small, only a short period of time passes before bobbins must be changed in the sewing machine. Consequently, the use of the lockstitch machine has been limited, particularly in automated equipment. Where large scale production is required, many manufacturers have resorted to employing chain stitch type machines which utilize only a single source of thread. This permits long-term continuous sewing without the inconvenience of necessarily changing the bobbin. The disadvantage of such a machine, however, is that the single thread, if cut or broken, will easily unravel when pulled.

Accordingly, there is a need for an apparatus, which may be incorporated into an automatic process, that permits a lockstitch to be produced on a continuous, uninterrupted basis.

SUMMARY OF THE INVENTION

The present invention entails an apparatus for changing the bobbin and bobbin carrier in a sewing machine. The apparatus comprises means for supplying bobbin carriers containing bobbins to the sewing machine, including means for guiding a lead bobbin carrier into the bobbin housing of the sewing machine. Also, the apparatus comprises means for moving the bobbin carrier supplying means between a first position wherein the guiding means is aligned with the bobbin housing, and a second position wherein the bobbin carrier supplying means is clear of the bobbin housing. Further, means is utilized for removing spent bobbins and corresponding bobbin carriers from the bobbin housing, and for positioning the bobbin carriers from the bobbin carrier supplying means in the bobbin housing.

In a preferred embodiment of the present invention the bobbin carrier supplying means further comprises a magazine, coupled to the frame of the sewing machine, having a first and a second end, and a longitudinal channel therethrough for containing a queue of the bobbin carriers. The guiding means comprises an opening disposed laterally through a first end of the magazine. The bobbin carrier supplying means also includes a plunger, operatively disposed in the channel so that the queue of bobbin carriers lies between the plunger and the first end of the magazine, the plunger being removable from the second end of the magazine. A constant force spring is coupled to the plunger, urging the plunger towards the first end of the magazine.

The moving means, in a preferred embodiment, comprises a first pneumatic cylinder, affixed to the frame of the sewing machine, having a first rod movably disposed therein, the first rod being alternately extendable from and retractable into the pneumatic cylinder in response to pneumatic pressure, the end of the first rod projecting from the pneumatic cylinder being coupled to the magazine.

The bobbin carrier removing and positioning means, in a preferred embodiment, comprises a second pneumatic cylinder, affixed to the frame of the sewing machine, having a second rod movably disposed therein, the second rod being alternately extendable from and retractable into the second pneumatic cylinder in response to pneumatic pressure. Further included is an electromagnet, configured for passing through the opening in the first end of the magazine, for holding, upon energization, one of the bobbin carriers, and for releasing, upon deenergization the held bobbin carrier. The electromagnet is coupled to an end of the second rod projecting from the second pneumatic cylinder so that when the magazine is in the second position clear of the bobbin housing the electromagnet is movable between a third position proximate the bobbin housing and a fourth position removed from the bobbin housing. The electromagnet is energizable to remove bobbin carriers from the bobbin housing when in the third position, and deenergizable to release a removed bobbin carrier when moving from the third to the fourth position. The fourth position of the electromagnet is configured so that when the magazine is in the first position wherein the opening is aligned with the bobbin housing, the opening is disposed between the bobbin housing and the electromagnet. The electromagnet is movable through the opening in the magazine to the third position proximate the bobbin housing, pushing a lead bobbin carrier from the opening of the magazine into the bobbin housing while so moving, and leaving the lead bobbin carrier in the bobbin housing while moving from the third to the fourth position through the opening in the magazine.

A preferred embodiment of the present invention further comprises an air nozzle, disposed proximate the bobbin housing, for applying a jet of air to the bobbin housing to remove spent, magnet nonresponsive bobbins. Additionally included is means for automatically operating the apparatus, comprising a source of pneumatic pressure; and, solenoid operated directional control valves, coupled thereto and to the first and second pneumatic cylinders. Further, a means is utilizled for sensing positions of the magazine and the electromagnet; and, a means is employed for energizing the electromagnet. A computer, responsive to the position sensing means, coupled to the solenoid operated directional control valves and the energizing means, regulates the solenoid operated directional control valves and the energizing means to effect the operations of the present invention.

BRIEF DESCRIPTION OF THE DRAWINGS

Identical numerals in different figures refer to identical elements.

DESCRIPTION OF THE PREFERRED EMBODIMENTS

The present invention entails an apparatus for changing bobbin carriers and corresponding bobbins in a sewing machine.

Figure 1:
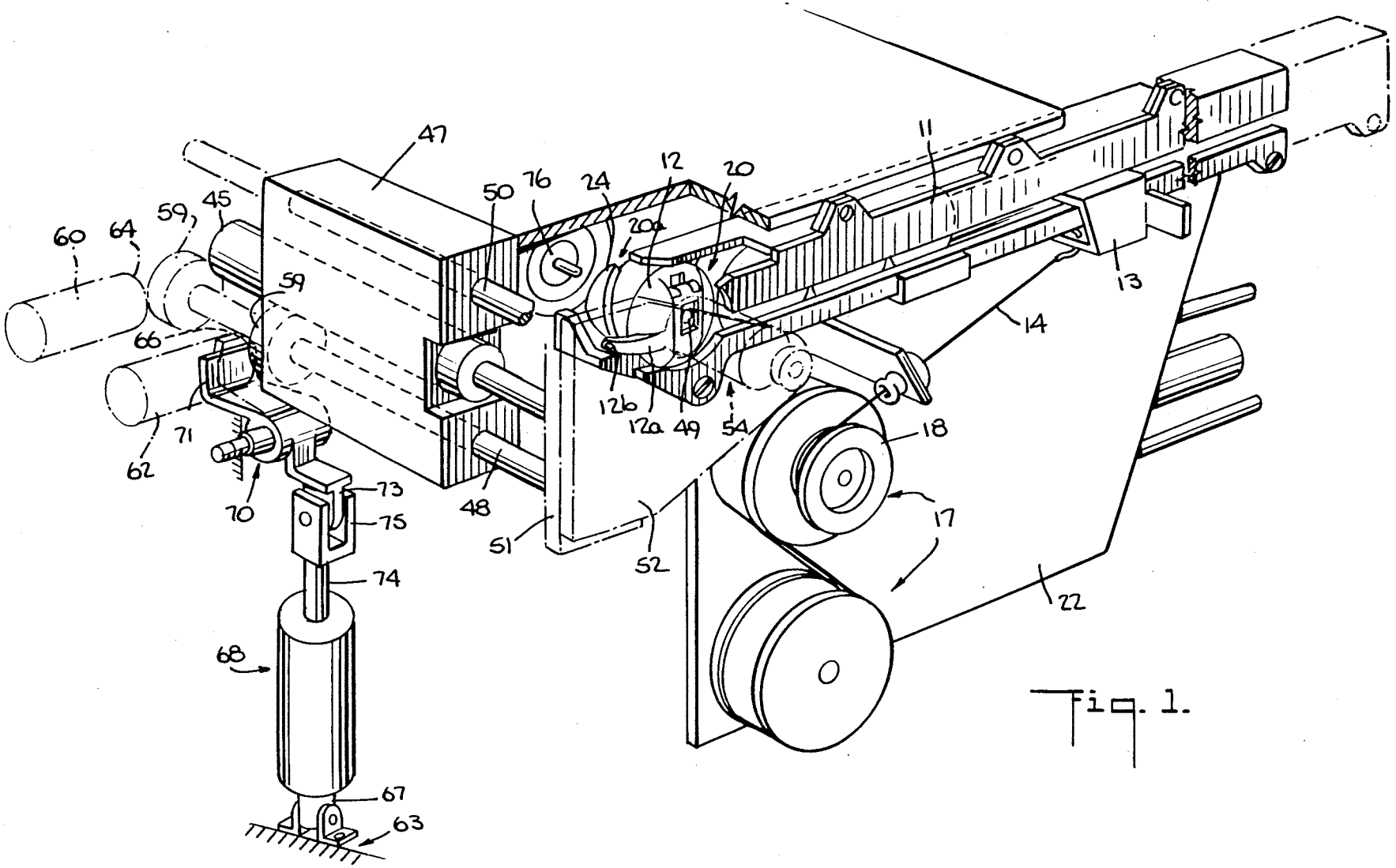
FIG. 1 is a perspective view of a preferred embodiment of the present invention.
Figure 2:
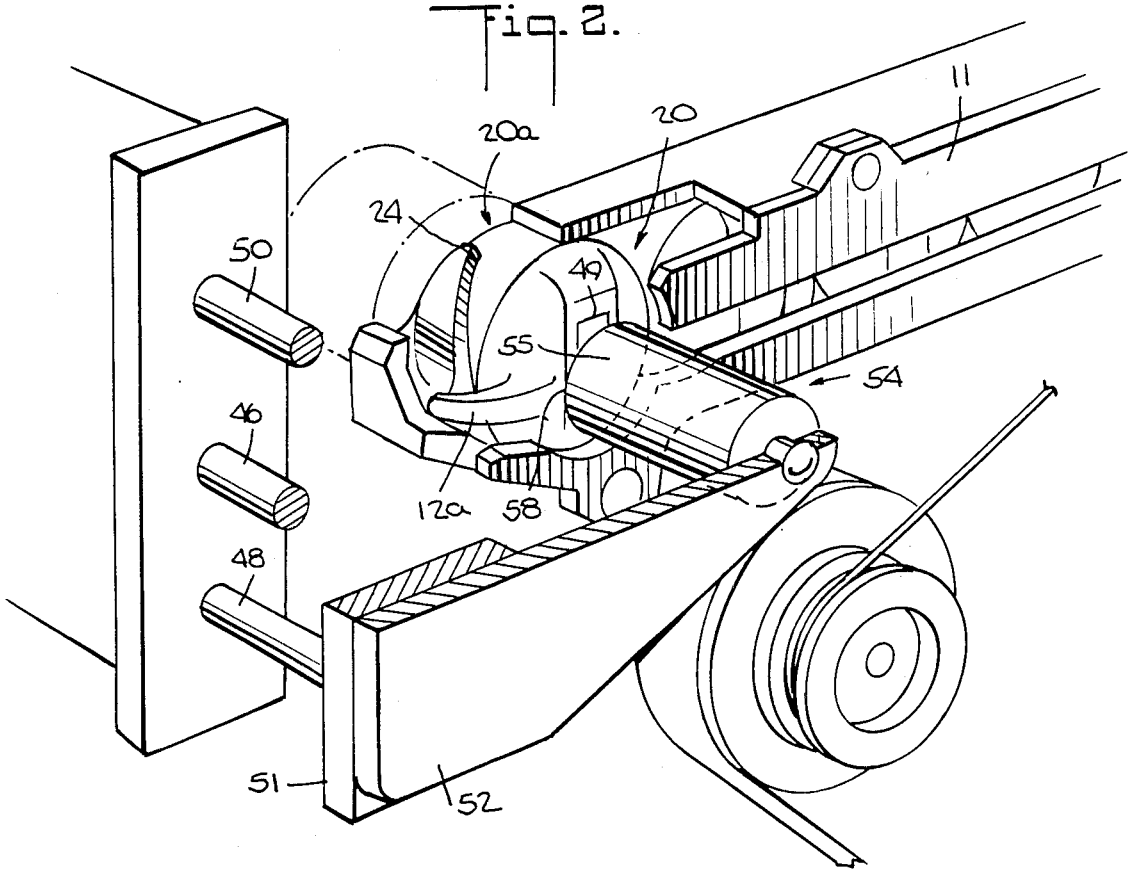
FIG. 2 is a perspective view of a portion of the preferred embodiment of the present invention wherein the magazine is in an extended position proximate the bobbin housing of the sewing machine, and the electromagnet is in an extended position withdrawn from the bobbin housing of the sewing machine.
Figure 3:
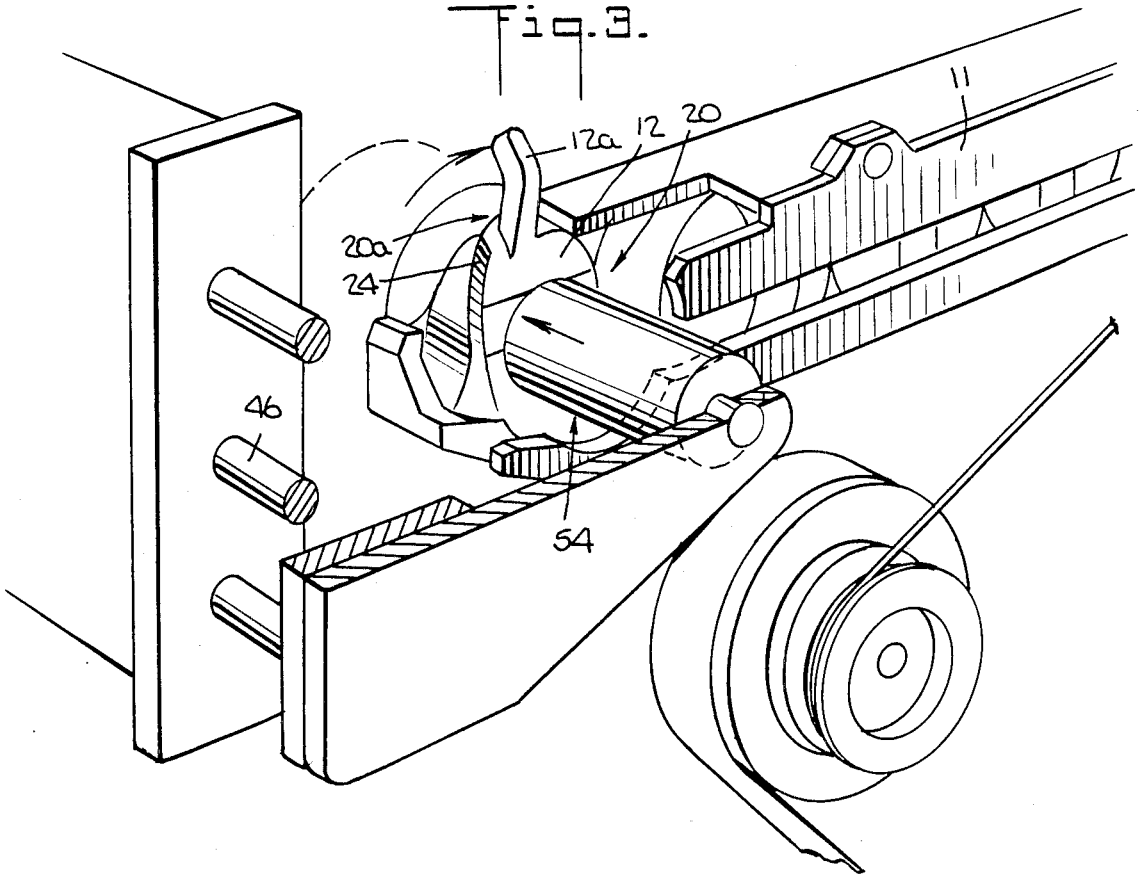
FIG. 3 is a perspective view of a portion of the preferred embodiment of the present invention wherein the magazine is in the extended position proximate the bobbin housing of the sewing machine, and the electromagnet is in a retracted position proximate the bobbin housing of the sewing machine.
Figure 16:
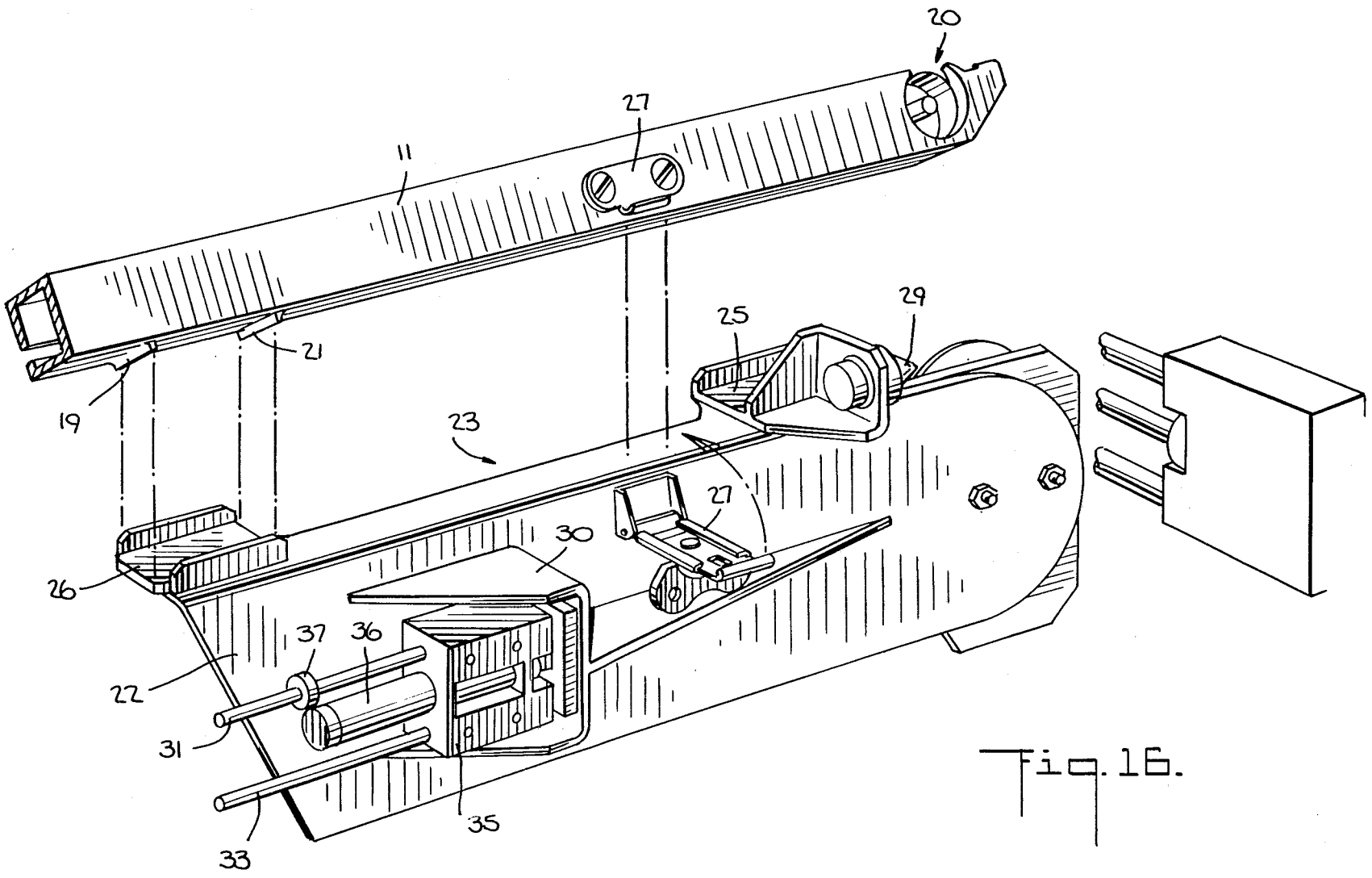
FIG. 16 is a perspective view of a portion of the back of the preferred embodiment of the invention, including an illustration of the detatchable magazine.

Referring to FIG. 1, a magazine 11 holds a queue of bobbin carriers. Each bobbin carrier in the queue, such as a lead bobbin carrier 12 comprises a thread holding arm 12*a* having an eye 12*b*, and contains a corresponding bobbin. Each bobbin carrier, such as the bobbin carrier 12, is arranged in the magazine 11 so that the side on which the thread holding arm 12*a* is disposed faces away from the sewing machine, and the open side, in which the bobbin is inserted, faces towards the sewing machine. A plunger 13 coupled, via a chord 14, to a spring mechanism 17 presses the bobbin carriers together in the queue and urges them forward in the magazine 11. The spring mechanism 17 is mounted on a support plate 22. The bobbin carriers in the queue behind the lead bobbin carrier 12 orient, owing to their configuration and the pressure applied by the plunger 13, with their thread holding arms proximate the bottom of the magazine 11, pointing towards the lead bobbin carrier 12. The spring mechanism 17 preferably comprises a constant force spring having a pulley 18 mounted thereto upon which the chord 14 is wound as the plunger 13 is drawn forward. An opening 20 disposed laterally through an end of the magazine 11 receives the lead bobbin carrier 12. Referring to FIGS. 2 and 3, the arm 12*a* of the lead bobbin carrier 12 rests upon a helically shaped surface 24 configured so that when the lead bobbin carrier 12 moves through the opening 20 towards the sewing machine the arm 12*a* moves upward, exiting through an opening 20*a* in the top of the magazine 11. Referring to FIG. 16, projections 19 and 21 are disposed on the lower surface of the magazine 11 a predetermined distance apart. A magazine tray 23 comprising a first bracket 25 and a second bracket 26 is affixed to a top edge of the support plate 22. Preferably, the magazine tray 23 is integral with the support plate 22. The brackets 25 and 26 are configured to hold the bottom surface of the magazine 11. The bracket 26 is disposed between and abutting the projections 19 and 21 so that horizontal movement of the magazine 11 relative to the magazine tray 23 is precluded.

Figure 4:
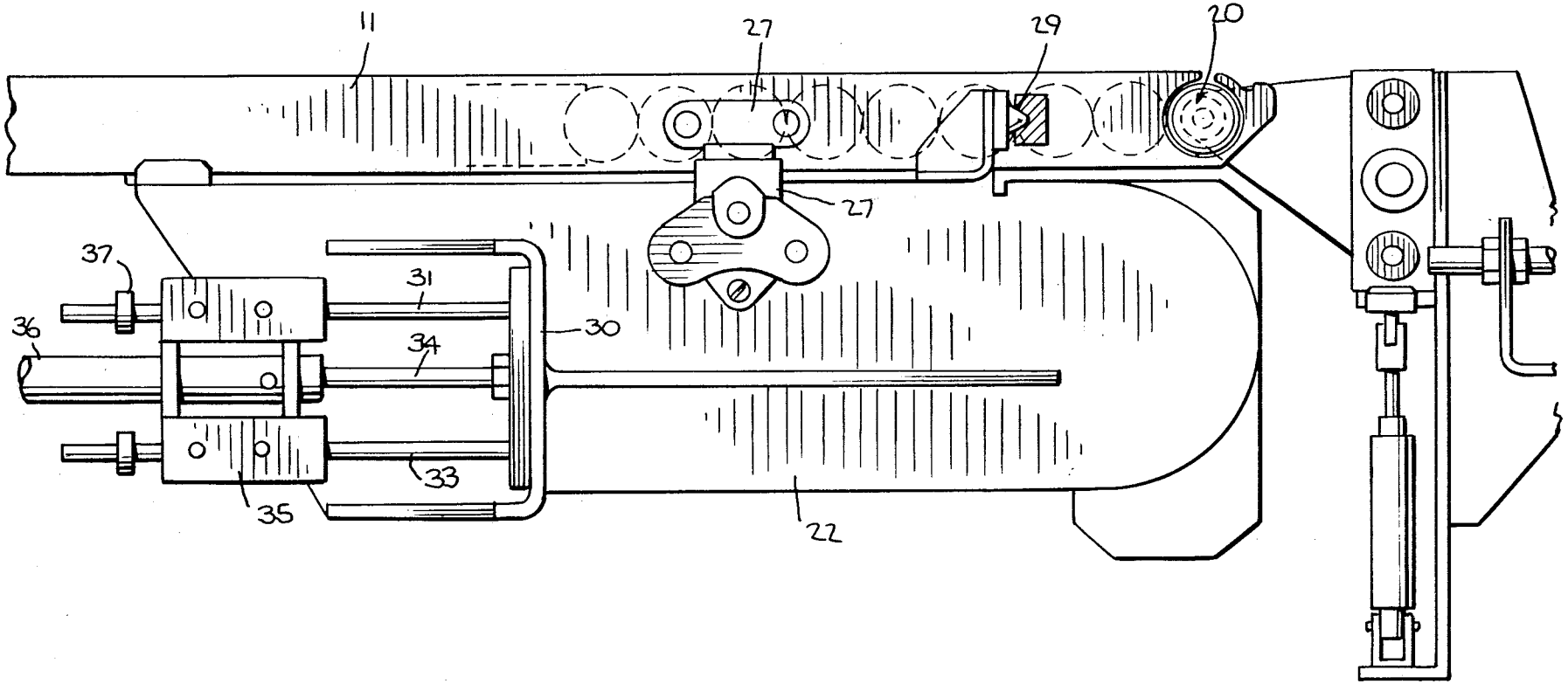
FIG. 4 is an elevational view of the back of the preferred embodiment of the present invention wherein the magazine is in the extended position.

Referring to FIGS. 4 and 16, a latch 27, having a first portion affixed to the back of the magazine 11 and a second portion affixed to the back of the support plate 22 is configured to preclude vertical movement of the magazine 11 relative to the magazine tray 23. Preferably, the latch 27 comprises a quarterturn toggle or cam type fastener. A tray locating pin 29 is affixed to the magazine tray 23 and disposed proximate the back surface of the magazine 11, to align the magazine 11 with a sewing machine. The tray locating pin 29 is designed to fit into a cup (not shown) disposed at a predetermined position on the sewing machine. A bracket 30 is affixed to the back of the support plate 22. Support rails 31 and 33 are movably disposed through a housing 35, and affixed at one end to the bracket 30. The housing 35 is affixed to the frame of the sewing machine (not shown). A pneumatic cylindler 36 having a rod 34 disposed movably therein is affixed in the housing 35. The rod 34 is extendable from and retractable into the pneumatic cylinder 36 in response to pneumatic pressure. The end of the rod is affixed to the bracket 30. The magazine 11, upon extension of the rod 34 from the pneumatic cylinder 36, moves to a first position wherein the guide opening 20 is aligned with the bobbin housing of the sewing machine; and, upon retraction of the rod 34 into the pneumatic cylinder 36, withdraws laterally away from the sewing machine, clearing the region before the bobbin housing. When the magazine 11 is in the first position the tray locating pin 29 is disposed to fit into the cup on the sewing machine.

A position indicator 37, preferably comprising an annulus of iron, is disposed on the support rail 31.

Figure 5:
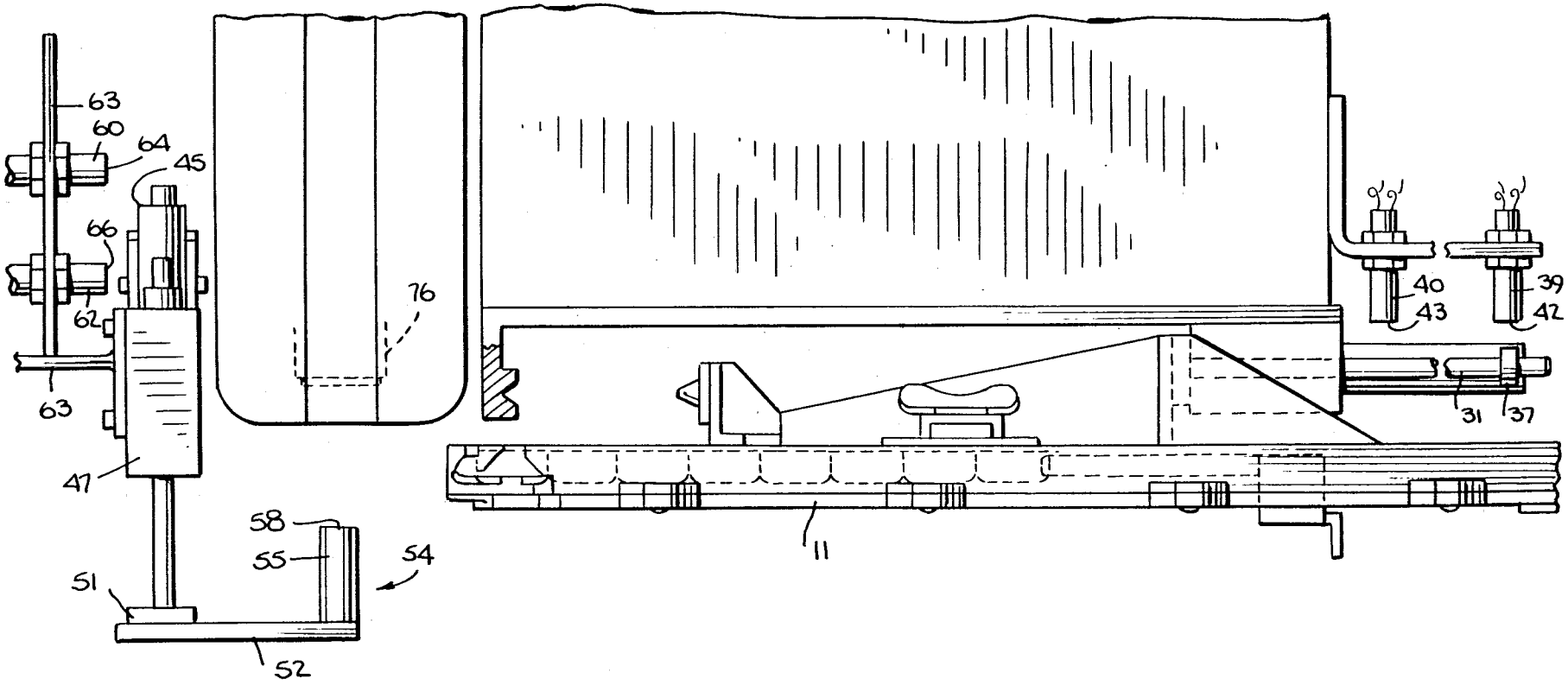
FIG. 5 is a plan view of the preferred embodiment of the present invention wherein the magazine is in a retracted position withdrawn from the bobbin housing of the sewing machine, and the electromagnet is in the extended position.
Figure 6:
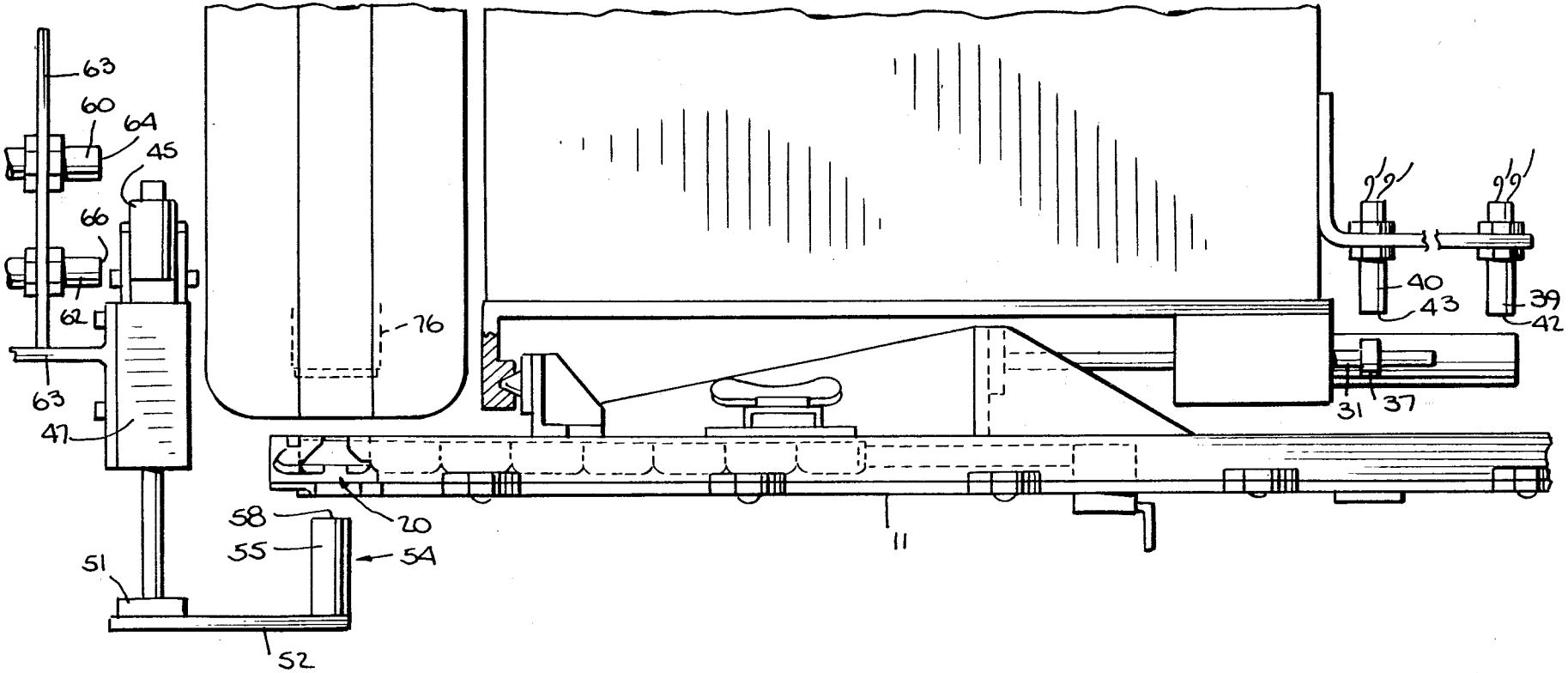
FIG. 6 is a plan view of the preferred embodiment of the present invention wherein the magazine is in the extended position and the electromagnet is in the extended position.

Referring to FIGS. 5 and 6, a position sensor 39, and a position sensor 40 are affixed to the frame of the sewing machine. The position sensors 39 and 40 are disposed so that the position indicator 37 is proximate a sensor end 42 of the position sensor 39 when the magazine 11 is in the second position (FIG. 5), and proximate a sensor end 43 of the position sensor 40 when the magazine 11 is in the first position (FIG. 6). When the position indicator 37 is proximate the sensor end 42 or 43, the corresponding position sensor 39 or 40 turns on a switch. When the position indicator 37 leaves the proximity of the sensor end 42 or 43, the switch of the corresponding position sensor 39 or 40 is turned off. Preferably, the position sensors 39 and 40 comprise proximity switches.

Figure 7:
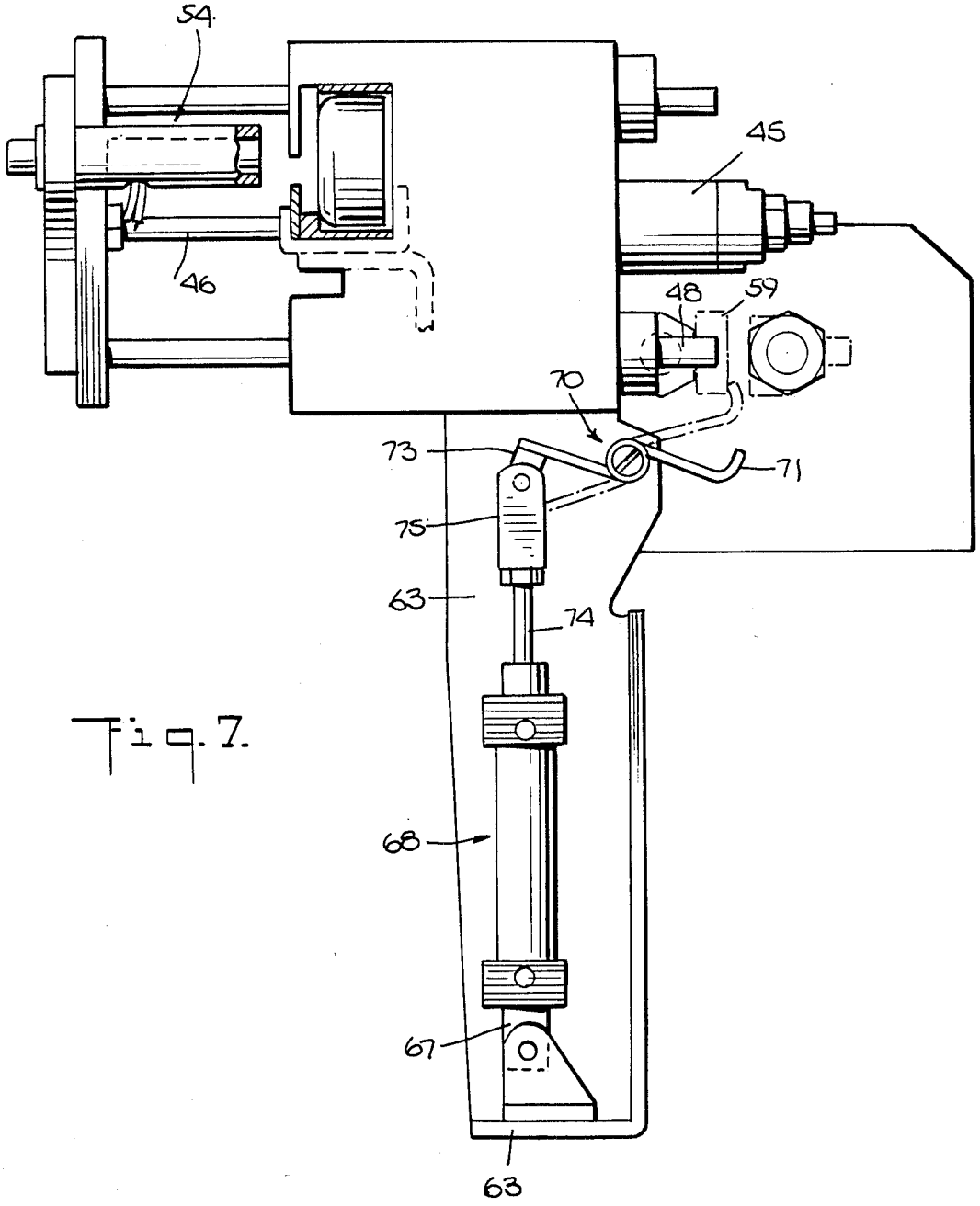
FIG. 7 is an elevational view of a portion of the preferred embodiment of the present invention comprising a stop member.

Referring to FIG. 1, a pneumatic cylinder 45, having a rod 46 disposed movably therein, is disposed with its longitudinal axis perpendicular to the longitudinal axis of the magazine 11. The pneumatic cylinder 45 is affixed in a housing 47 which is attached to the frame of the sewing machine. Support rails 48 and 50 extend through the housing 47, parallel to the movable rod 46, and are movable relative to the housing 47. The ends of the support rails 48 and 50, and the rod 46 are affixed to a plate 51 which is perpendicular to the longitudinal axes of the support rails 48 and 50 and the rod 46. Referring to FIGS. 2 and 6, a magnet bracket 52, holding an electromagnet 54, is affixed to the plate 51. The electromagnet 54 comprises a cylindrical casing 55 having a longitudinal axis parallel to that of the rod 46; and, a magnetizeable core. The cylindrical casing 55 is configured to pass through the guide opening 20 of the magazine 11. An end 58 of the electromagnet 54 is disposed in a plane parallel to that of the plate 51. Alternatively, a projection, configured for insertion into a central hole 49 of a bobbin carrier, may be disposed perpendicularly on the surface of the magnetizeable core of the electromagnet 54. Referring to FIGS. 1 and 6, a position indicator 59, preferably comprising an annulus of iron, is disposed on an end of the support rail 48 remote from the plate 51. In response to activation of the pneumatic cylinder 45, the electromagnet 54 moves between a first position, when the rod 46 is retracted within the cylinder 45, and a second position, when the rod 46 is extended from the cylinder 45. In the first position the electromagnet 54 is in alignment with and proximate the bobbin housing of the sewing machine. In the second position the electromagnet 54 is withdrawn from and aligned with the bobbin housing, and disposed so that the guide opening 20 is aligned between the bobbin housing and the electromagnet 54 when the magazine 11 is in the first position. Similarly, the position indicator 59 moves between a corresponding first position and a second position. Position sensors 60 and 62 are mounted on a bracket 63 to which the housing 47 is affixed. The bracket 63 is affixed to the frame of the sewing machine. The position sensors 60 and 62 are disposed so that a sensor end 64 of the position sensor 60 is proximate the first position of the position indicator 59, and a sensor end 66 of the position sensor 62 is proximate the second position of the position indicator 59. When the position indicator 59 is proximate the sensor end 64 or 66, the corresponding position sensor 60 or 62 turns on a switch. When the position indicator 59 leaves the proximity of the sensor end 64 or 66, the switch of the corresponding position sensor 60 or 62 is turned off. Preferably, the position sensors 60 and 62 comprise proximity switches. Referring to FIGS. 1 and 7, a first end 67 of a pneumatic cylinder 68 is pivotally mounted to the bracket 63. A stop member 70, having a stop end 71 and a coupling end 73, is pivotally mounted to the bracket 63. The pneumatic cylinder 68 has a rod 74 movably disposed therein, which alternates between a retracted first position and an extended second position in response to pneumatic pressure. The coupling end 73 of the stop member 70 is pivotally coupled to an end 75 of the rod 74. When the rod 74 is in the retracted first position, the stop end 71 of the stop member 70 is elevated so that the position sensor 59 in the second position is blocked upon activation of the pneumatic cylinder 45 from attaining the first position; but, assumes a position intermediary thereto.

Figure 8:
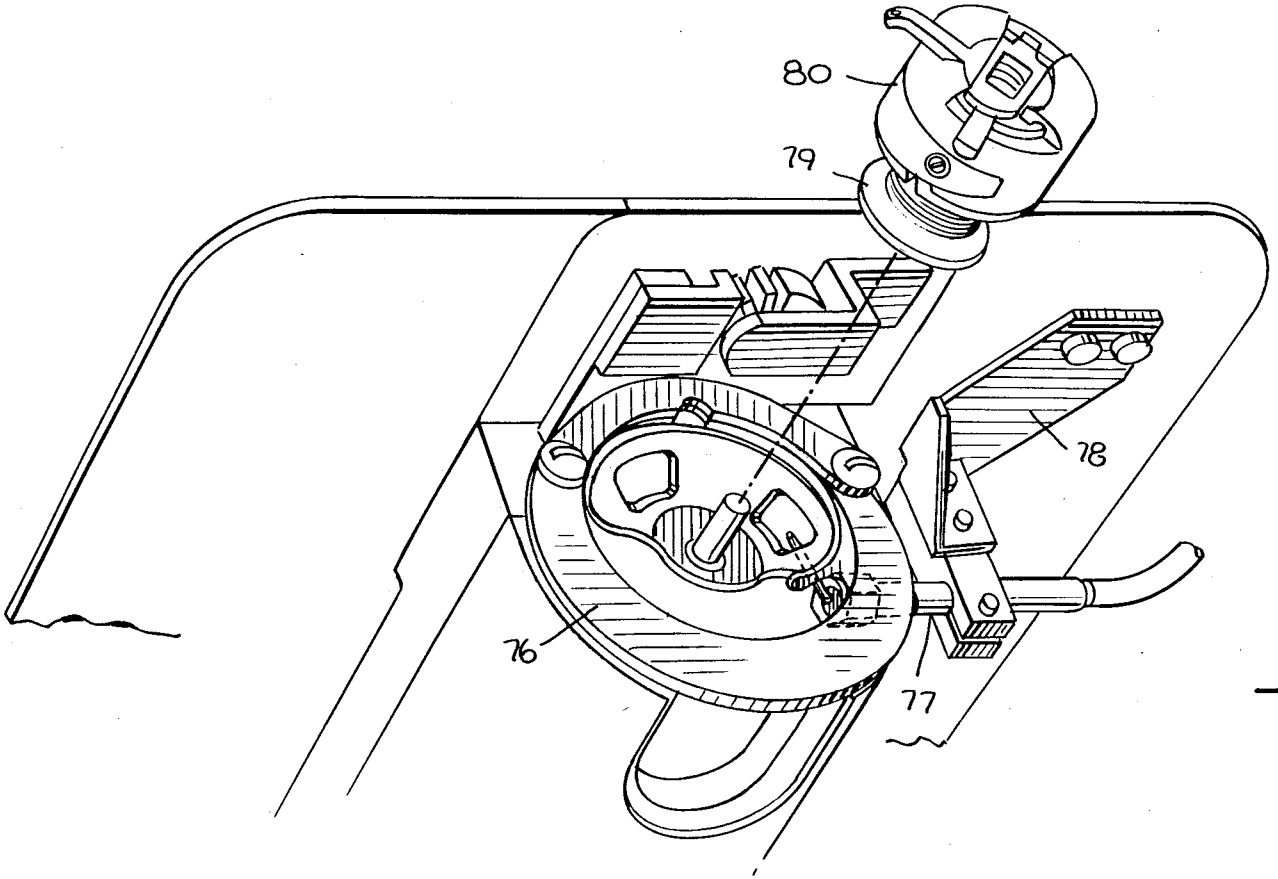
FIG. 8 is a perspective view of the underside of the sewing machine comprising the bobbin housing, and an air nozzle with a bracket of the preferred embodiment of the present invention affixed to the sewing machine.

Referring to FIG. 8, an air nozzle 77 is affixed to a bracket 78 which is mounted on the frame of the sewing machine. The air nozzle 77 is disposed so that a jet of air therefrom impinges upon a bobbin spool 79 in a bobbin carrier 80 in the bobbin housing 76 of the sewing machine.

Figure 9:
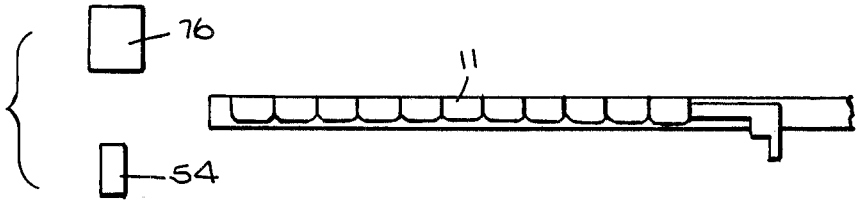
FIG. 9 is a simplified plan view of the preferred embodiment of the present invention wherein the magazine is in the retracted position, and the electromagnet is in the extended position.
Figure 10:
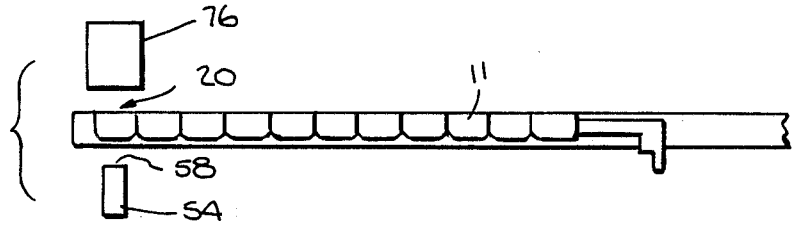
FIG. 10 is a simplified plan view of the preferred embodiment of the present invention wherein the magazine is in the extended position, and the electromagnet is in the extended position.
Figure 11:
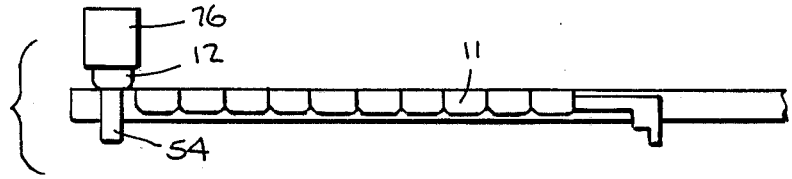
FIG. 11 is a simplified plan view of the preferred embodiment of the present invention wherein the magazine is in the extended position, and the electromagnet is in the retracted position.
Figure 12:
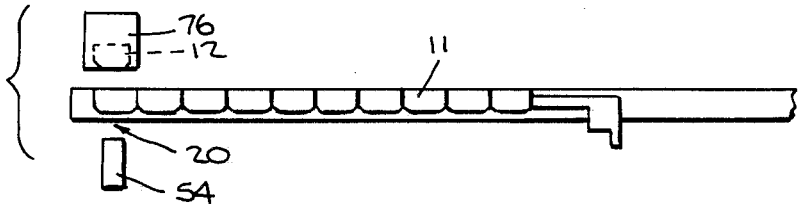
FIG. 12 is a simplified plan view of the preferred embodiment of the present invention wherein the magazine is in the extended position, and the electromagnet is in the extended position.
Figure 13:
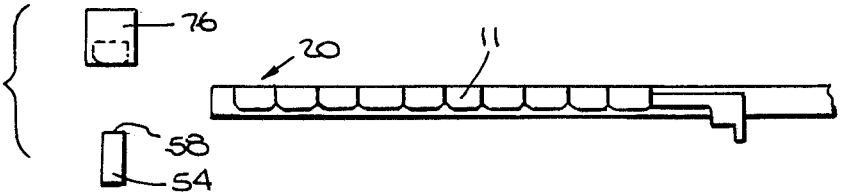
FIG. 13 is a simplified plan view of the preferred embodiment of the present invention wherein the magazine is in the retracted position, and the electromagnet is in the extended position.
Figure 14:
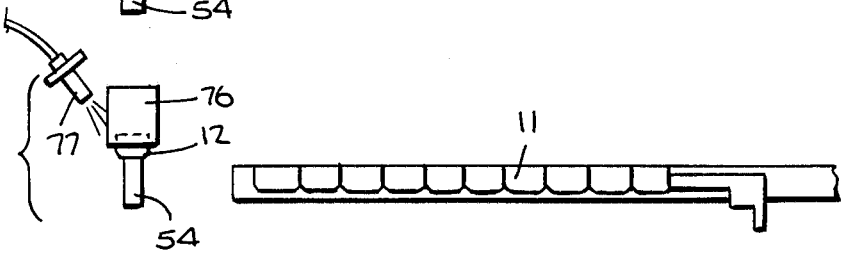
FIG. 14 is a simplified plan view of the preferred embodiment of the present invention wherein the magazine is in the retracted position, the electromagnet is in the retracted position, and an air nozzle is discharging air towards the bobbin housing.
Figure 15:
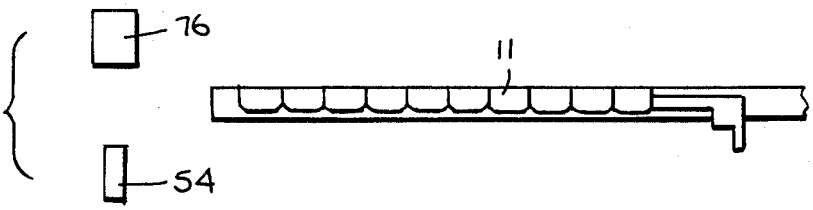
FIG. 15 is a simplified plan view of the preferred embodiment of the present invention wherein the magazine is in the retracted position, and the electromagnet is in the extended position.

The operation of the present invention is described here below. Referring to FIGS. 1 and 9, the electromagnet 54, in response to activation of the pneumatic cylinder 45 which extends the rod 46, moves away from the bobbin housing 76 of the sewing machine to the second position. Referring to FIGS. 4 and 10, the magazine 11, having a queue of bobbin carriers containing bobbins, in response to activation of the pneumatic cylinder 36 which extends the rod 34, moves so that the guide opening 20 is aligned with the bobbin housing 76 of the sewing machine, disposed between the end 58 of the electromagnet 54, and the bobbin housing 76. Referring to FIGS. 1 and 3, in response to activation of the pneumatic cylinder 45 which retracts the rod 46, the electromagnet 54 is moved through the guide opening 20, pushing the lead bobbin carrier 12 so that the arm 12*a* moves upward along the helically shaped surface 24, exiting the magazine 11 from the opening 20*a*, clearing the automatic thread cutoff mechanism of the sewing machine. Referring to FIG. 11, the lead bobbin carrier 12 is transported by the electromagnet 54 into the bobbin housing 76 of the sewing machine. Referring to FIGS. 1 and 12, the electromagnet 54 is withdrawn through the guide opening 20 upon activation of the pneumatic cylinder 45 which extends the rod 46, leaving the lead bobbin carrier 12 containing a bobbin in the bobbin housing 76 of the sewing machine. Another bobbin carrier in the queue of the magazine 11 is forced into the guide opening 20 by the plunger 13 which pushes the entire queue forward. Referring to FIGS. 4 and 13, the magazine 11 is drawn back, upon activation of the pneumatic cylinder 36 which retracts the rod 34, so that the region between the end 58 of the electromagnet 54 and the bobbin housing 76 of the sewing machine is clear. Referring to FIG. 7, the electromagnet 54 may be stored closer to the sewing machine but removed from the bobbin housing 76 by activation of the pneumatic cylinder 68 which retracts the rod 74, elevating the stop end 71 of the stop member 70. Upon activation of the pneumatic cylinder 45 which retracts the rod 46, the stop end 71 of the stop member 70 blocks the position indicator 59 so that the electromagnet 54 is held intermediary to its first and second positions, away from adjacent equipment. Referring to FIGS. 1 and 14, when the thread on the bobbin is exhausted, the electromagnet 54 is energized, and in response to activation of the pneumatic cylinder 68 which extends the rod 74 lowering the stop end 71 (if the electromagnet 54 is in the intermediary position blocked by the elevated stop end 71 of the stop member 70), or in response to activation of the pneumatic cylinder 45 which retracts the rod 46 (if the electromagnet 54 is in the second position with the stop end 71 lowered), the electromagnet 54 is moved forward, contacting and magnetically holding a latch on the bobbin housing 76. In response to activation of the pneumatic cylinder 45 which extends the rod 46, the electromagnet 54 is withdrawn, unlatching the bobbin housing 76 and magnetically pulling the bobbin carrier 12 therefrom. A jet of air from the air nozzle 77, aimed at the bobbin housing 76 in the direction of the withdrawing electromagnet 54 ensures that an expended bobbin, particularly a non-metallic one such as of cardboard, is also removed from the bobbin housing 76. Referring to FIGS. 1 and 15, the electromagnet 54 is deenergized, dropping the bobbin carrier with any spent bobbin therein into a container or chute, and returns to the fully withdrawn position corresponding to complete extension of the rod 46. Referring to FIGS. 4 and 10, in response to activation of the pneumatic cylinder 36 which opening 20 is aligned with the bobbin housing 76 of the sewing machine. As described above, a bobbin and bobbin carrier disposed in the guide opening 20 of the magazine 11 is now pushed into the bobbin housing 76 of the sewing machine by the electromagnetic 54. This cycle is replicated, to load bobbin carriers containing bobbins into the bobbin housing of the sewing machine and to remove bobbin carriers containing spent bobbins from the bobbin housing 76.

Referring to FIGS. 1 and 16, after a bobbin carrier has been loaded from the magazine 11 into the bobbin housing 76, additional bobbin carriers may be added to the magazine 11 by withdrawing the plunger 13 from the end thereof and manually inserting them in the magazine 11. Preferably, upon depletion of the bobbin carriers in the magazine 11, the magazine 11 is removed manually from the magazine tray 23 by withdrawing the plunger 13 from the end thereof and unfastening the latch 27. The magazine 11 is then manually replaced with a similar second magazine loaded with bobbin carriers. The second magazine is fastened to the magazine tray 23 via the latch 27, and the plunger 13 is inserted into an end thereof.

The operations of the present invention may be automatically effected by a computer or microprocessor based device which energizes solenoid operated directional control valves and regulates a source of electricity to control the various activities. The same computer also monitors the number of minutes of sewing time and determines when a bobbin change is required.

Figure 17:
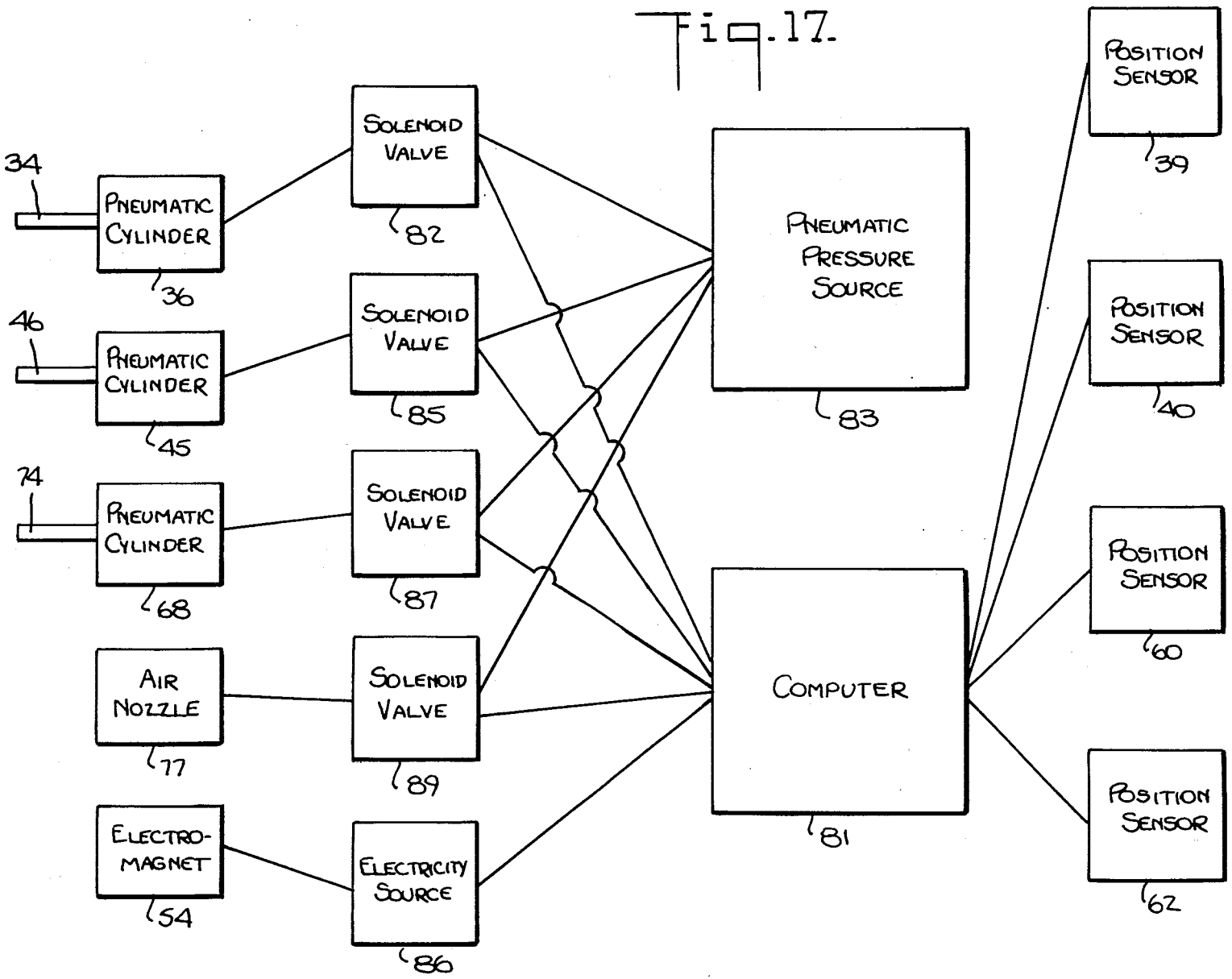
FIG. 17 is a block diagram of an automation system of the preferred embodiment of the present invention.

Specifically, referring to FIGS. 1, 5 and 9, assuming the electromagnet 54 is in the second position removed from the bobbin housing 76, the magazine 11 is in the second position withdrawn laterally from the sewing machine, and the stop end 71 of the stop member 70 is not blocking the path of the position indicator 59, then the position indicator 37 on the support rail 31 is proximate the sensor end 42 of the position sensor 39, and the position indicator 59 on the support rail 48 is proximate the sensor end 66 of the position sensor 62. In response, the position sensors 39 and 62 generate signals. Referring to FIG. 17, a computer 81, coupled to the position sensors 39, 40, 60 and 62, in response to the signals from the position sensors 39 and 62 indicating the positions, respectively, of the magazine 11 and the electromagnet 54, signals a first solenoid operated directional control valve 82 coupled to the pneumatic cylinder 36. In response, the first solenoid operated directional control valve 82 vents the pneumatic cylinder 36, and directs pneumatic pressure from a pneumatic pressure source 83 to the pneumatic cylinder 36 so as to extend the rod 34 therefrom. Referring to FIG. 10, the magazine 11 is thereby moved to the first position wherein the guide opening 20 is aligned between the bobbin housing 76 and the electromagnet 54. Referring to FIG. 6, the position indicator 37 aligns with the sensor end 43 of the position sensor 40. Referring to FIG. 17, in response, the position sensor 40 generates a signal to which the computer 81 responds by signaling a second solenoid operated directional control valve 85 coupled to the pneumatic cylinder 45. In response, the second solenoid operated directional control valve 85 vents the pneumatic cylinder 45, and directs pneumatic pressure from the pneumatic pressure source 83 to the pneumatic cylinder 45 so as to retract the rod 46 there into. Referring to FIGS. 3 and 11, the lead bobbin carrier 12 is thus pushed by the electromagnet 54 through the guide opening 20, with the arm **12*a* rising on the helical surface 24, into the bobbin housing 76 of the sewing machine. Referring to FIG. 1, the position indicator 59 on the support rail 48 aligns with the sensor end 64 of the position sensor 60. Referring to FIG. 17, in response, the position sensor 60 signals the computer 81 which responds by signaling the second solenoid operated directional control valve 85. The second solenoid operated directional control valve 85, in response, vents the pneumatic cylinder 45, and directs pneumatic pressure from the pneumatic pressure source 83 to the pneumatic cylinder 45 so as to extend the rod 46 therefrom. Referring to FIG. 12, the electromagnet 54 thereby withdraws from the bobbin housing 76 through the guide opening 20, leaving the lead bobbin 12 in the bobbin housing 76. Referring to FIG. 1, the position indicator 59 on the support rail 48 aligns with the sensor end 66 of the position sensor 62. Referring to FIG. 17, in response, the position sensor 62 signals the computer 81 which in turn signals the first solenoid operated directional control valve 82 coupled to the pneumatic cylinder 36. The second solenoid operated directional control valve 82, in response, vents the pneumatic cylinder 36, and directs pneumatic pressure from the pneumatic pressure source 83 to the pneumatic cylinder 36 so as to retract the rod 34 there into. Referring to FIG. 13, the magazine 11, accordingly, withdraws laterally from the sewing machine with the guide opening 20 clearing the space between the electromagnet 54 and the bobbin housing 76. Referring to FIG. 5, the position indicator 37 on the support rail 31 aligns with the sensor end 42 of the position sensor 39. Referring to FIG. 17, in response, the position sensor 39 signals the computer 81 which may be programmed to, in turn, signal the second solenoid operated directional control valve 85, and a third solenoid operated directional control valve 87 coupled to the pneumatic cylinder 68 and the pneumatic pressure source 83. The third solenoid operated directional control valve 87, in response, vents the pneumatic cylinder 68, and directs pneumatic pressure from the pneumatic pressure source 83 to the pneumatic cylinder 68 so as to retract the rod 74 there into. Referring to FIGS. 7 and 17, the stop end 71 of the stop member 70 rises, accordingly, to block the path of the position sensor 59 on the support rail 48. The second solenoid operated directional control valve 85, in response to the computer 81, vents the pneumatic cylinder 45, and directs pneumatic pressure from the pneumatic pressure source 83 to the pneumatic cylinder 45 so as to retract the rod 46 there into. The electromagnet 54 moves, accordingly, towards the sewing machine, asssuming a position intermediary to its first and second when the position indicator 59 is blocked by the elevated stop end 71 of the stop member 70. The electromagnet 54** is stored in the intermediary position clear of surrounding equipment.

Referring to FIG. 17, the computer 81 monitors the sewing time and determines, accordingly, when a bobbin change is required. At such time, the computer 81 signals the third solenoid operated directional control valve 87 which in response vents the pneumatic cylinder 68, and directs pneumatic pressure from the pneumatic pressure source 83 to the pneumatic cylinder 68 so as to extend the rod 74 therefrom. Referring to FIGS. 7 and 17, the stop end 71 of the stop member 70 is lowered, accordingly, unblocking the path of the position indicator 59 on the support rail 48. The retraction of the rod 46 into the pneumatic cylinder 45 is then completed in response to pneumatic pressure being supplied thereto by the pneumatic pressure source 83 via the second solenoid operated directional control valve 85. Referring to FIG. 14, the electromagnet 54 moves to the first position adjacent the bobbin housing 76. Referring to FIGS. 1 and 17, the position indicator 59 aligns with the sensor end 64 of the position sensor 60. In response, the position sensor 60 signals the computer 81 which, in turn, signals the electricity source 86, the second solenoid operated directional control valve 85, and a fourth solenoid operated directional control valve 89 coupled to the air nozzle 77 and the pneumatic pressure source 83. In response, the electricity source 86 energizes the electromagnet 54, the second solenoid operated directional control valve 85 vents the pneumatic cylinder 45, and directs pneumatic pressure from the pneumatic pressure source 83 to the pneumatic cylinder 45 so as to extend the rod 46 therefrom, and the fourth solenoid operated directional control valve 89 directs pneumatic pressure from the pneumatic pressure source 83 to the air nozzle 77. Accordingly, the energized electromagnet 54 withdraws, unlatching the bobbin housing 76 and drawing the bobbin carrier therefrom. Referring to FIG. 14, simultaneously, the air nozzle 77 directs a jet of air at the bobbin housing 76 in the direction of the withdrawing electromagnet 54 to ensure removal of a spent bobbin, particularly a nonmetallic one, with the bobbin carrier. The electromagnet 54 carrying the bobbin carrier containing a spent bobbin moves to the fully withdrawn second position. Referring to FIGS. 1 and 17, the position indicator 59 on the support rod 48 aligns with the sensor end 66 of the sensor 62. In response, the sensor 62 signals the computer 81 which, in turn, signals the electricity source 86 and the fourth solenoid operated directional control valve 89. The fourth solenoid operated directional control valve 89, in response, directs pneumatic pressure from the pneumatic pressure source 83 away from the air nozzle 77. The electricity source 86, in response, deenergizes the electromagnet 54. Accordingly, the jet of air from the air nozzle 77 ceases, and the bobbin carrier with spent bobbin are dropped into a chute which directs them away for reloading and recycling. Referring to FIGS. 1 and 5, in response to signals from the position sensors 39 and 62 the cycle now repeats.

The operations of the apparatus may also be regulated automatically in response to timing rather than signals from position sensors. That is, rather than effecting certain operations in response to signals from sensors which indicate various positions, the operations may simply be automatically executed according to a particular timing sequence. For example, at a first time a first set of operations are executed, at a subsequent second time, a second set of operations are executed, and so on. The period between execution times is calculated to allow for full execution of one set of operations before the subsequent set is initiated.

Further, an operator, in lieu of the computer 81, may monitor thread use, and initiate, when deemed appropriate, the automatic bobbin and bobbin carrier change described above. To the extent desirable, any of the operations of the invention described above may also be initiated manually rather than automatically.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An apparatus for changing bobbins and bobbin carriers in a sewing machine having a bobbin housing and a frame, comprising:

means, adapted to be coupled to said frame of said sewing machine, for supplying a queue of bobbin carriers containing bobbins to said sewing machine, including means for guiding a lead bobbin carrier of said bobbin carriers into said bobbin housing;

means, adapted to be coupled to said frame, and coupled to said bobbin carrier supplying means, for linearly reciprocating said bobbin carrier supplying means between a first position wherein said guiding means is aligned with said bobbin housing and a second position wherein said bobbin carrier supplying means is clear of said bobbin housing; and means, adapted to be coupled to said frame, for removing spent bobbins and corresponding bobbin carriers from said bobbin housing, and for positioning said bobbin carriers from said bobbin carrier supplying means in said bobbin housing.

2. An apparatus for changing bobbins and bobbin carriers in a sewing machine having a bobbin housing and a frame, comprising:

means adapted to be coupled to said frame of said sewing machine, for supplying bobbin carriers containing bobbins to said sewing machine, including means for guiding a lead bobbin carrier of said bobbin carriers into said bobbin housing;

means for holding said bobbin carriers; and means for positioning said lead bobbin carrier in register with said guiding means;

means, adapted to be coupled to said frame, and coupled to said bobbin carrier supplying means, for moving said bobbin carrier supplying means between a first position wherein said guiding means is aligned with said bobbin housing and a second position wherein said bobbin carrier supplying means is clear of said bobbin housing; and means, adapted to be coupled to said frame, for removing spent bobbins and corresponding bobbin carriers from said bobbin housing, and for positioning said bobbin carriers from said bobbin carrier supplying means in said bobbin housing, wherein said holding means comprises a magazine, adapted to be coupled to said frame of said sewing machine, having a first and a second end, and a longitudinal channel therethrough for containing a queue of said bobbin carriers;

wherein said guiding means comprises an opening disposed laterally through said first end of said magazine; and, wherein said positioning means includes:

a plunger, operatively disposed in said channel so that said queue of bobbin carriers lies between said plunger and said first end, said plunger being removable from said second end of said magazine; and, means, coupled to said plunger, for urging said plunger towards said first end of said magazine.

3. An apparatus as in claim 2 wherein said moving means comprises a first pneumatic cylinder, adapted to be affixed to said frame of said sewing machine, having a first rod movably disposed therein, said first rod being alternately extendable from and retractable into said pneumatic cylinder in response to pneumatic pressure, a first end of said first rod projecting from said first pneumatic cylinder being coupled to said magazine so that said magazine moves with said rod.

4. An apparatus as in claim 3 wherein said bobbin carrier removing and positioning means comprises a second pneumatic cylinder, adapted to be affixed to said frame of said sewing machine, having a second rod movably disposed therein, said second rod being alternately extendable from and retractable into said second pneumatic cylinder in response to pneumatic pressure; and an electromagnet, configured for passing through said opening in said first end of said magazine, coupled to a first end of said second rod projecting from said second pneumatic cylinder so that when said magazine is in said second position clear of said bobbin housing said electromagnet is movable between a third position proximate said bobbin housing and a fourth position removed from said bobbin housing, said electromagnet being energizable to remove a first bobbin carrier from said bobbin housing when in said third position, and being deenergizable to release said first bobbin carrier when moving from said third to said fourth position, said fourth position of said electromagnet being configured so that when said magazine is in said first position wherein said opening is aligned with said bobbin housing, said opening is disposed between said bobbin housing, and said electromagnet, said electromagnet being movable to said third position proximate said bobbin housing through said opening, pushing said lead bobbin carrier into said bobbin housing while so moving, and being movable from said third to said fourth position through said opening, leaving said lead bobbin carrier in said bobbin housing while so moving.

5. An apparatus as in claim 4 wherein said bobbin carrier removing and positioning means further comprises an air nozzle, adapted to be affixed proximate said bobbin housing, for applying a jet of air to said bobbin housing to remove spent bobbins.

6. An apparatus as in claim 5 wherein said magazine is adapted to be detached from said frame of said sewing machine so that said magazine, upon exhaustion of said bobbin carriers therein, may be replaced with a similar magazine.

7. An apparatus as in claim 6 further comprising means, coupled to said apparatus, for automatically operating said apparatus.

8. An apparatus as in claim 7 wherein said automatic operating means comprises:

means for supplying pneumatic pressure;

two solenoid operated directional control valves, coupled to said pneumatic pressure supplying means and to, respectively, said first and second pneumatic cylinders;

means, adapted to be affixed to said frame, for sensing positions of said magazine and said electromagnet;

means, coupled to said electromagnet, for energizing said electromagnet; and, a computer, responsive to said position sensing means, coupled to said solenoid operated directional control valves and said energizing means, for regulating said solenoid operated directional control valves and said energizing means.

9. An apparatus as in claim 8 further comprising a helical surface disposed proximate said opening in said magazine so that as said lead bobbin carrier moves through said opening towards said bobbin housing an arm of said lead bobbin carrier moves upward along said helical surface.

10. An apparatus for changing bobbins and bobbin carriers in a sewing machine having a bobbin housing and a frame, comprising:

means, adapted to be coupled to said frame of said sewing machine, for supplying bobbin carriers containing bobbins to said sewing machine, including means for guiding a lead bobbin carrier of said bobbin carriers into said bobbin housing;

means, adapted to be coupled to said frame, and coupled to said bobbin carrier supplying means, for moving said bobbin carrier supplying means between a first position wherein said guiding means is aligned with said bobbin housing and a second position wherein said bobbin carrier supplying means is clear of said bobbin housing, said moving means comprising a first pneumatic cylinder, adapted to be affixed to said frame of said sewing machine, having a first rod movable disposed therein, said first rod being alternately extendable from and retractable into said first pneumatic cylinder in response to pneumatic pressure, a first end of said first rod projecting from said first pneumatic cylinder being coupled to said bobbin carrier supplying means;

means, adapted to be coupled to said frame, for removing spent bobbins and corresponding bobbin carriers from said bobbin housing, and for positioning said bobbin carriers from said bobbin carrier supplying means in said bobbin housing, said bobbin carrier removing and positioning means comprising a second pneumatic cylinder, adapted to be affixed to said frame of said sewing machine, having a second rod movably disposed therein, said second rod being alternately extendable from and retractable into said second pneumatic cylinder in response to pneumatic pressure; and an electromagnet coupled to a first end of said second rod projecting from said second pneumatic cylinder so that when said bobbin carrier supplying means is in said second position clear of said bobbin housing said electromagnet is movable between a third position proximate said bobbin housing and a fourth position removed from said bobbin housing, said electromagnet being energizable to remove a first bobbin carrier from said bobbin housing when in said third position, and being deenergizable to release said first bobbin carrier when moving from said third to said fourth position, said fourth position of said electromagnet being disposed so that when said bobbin carrier supplying means is in said first position wherein said guiding means is aligned with said bobbin housing, said guiding means is disposed between said bobbin housing and said electromagnet, said electromagnet being movable to said third position proximate said bobbin housing in cooperation with said guiding means, pushing said lead bobbin carrier into said bobbin housing in so moving, and being movable from said third to said fourth position in cooperation with said guiding means, leaving said lead bobbin carrier in said bobbin housing while so moving; and means, coupled to said apparatus, for automatically operating said apparatus, including:

means for supplying pneumatic pressure;

two solenoid operated directional control valves, coupled to said first and second pneumatic cylinders and said pneumatic pressure supplying means;

means, adapted to be affixed to said frame of said sewing machine, for sensing positions of said bobbin carrier supplying means and said electromagnet;

means, coupled to said electromagnet, for energizing said electromagnet; and, a computer, responsive to said position sensing means, coupled to said solenoid operated directional control valves and said energizing means, for regulating said solenoid operated directional control valves and said energizing means.

11. An apparatus for changing bobbins and bobbin carriers in a sewing machine having a bobbin housing and a frame, comprising:

means, adapted to be coupled to said frame of said sewing machine, for supplying bobbin carriers containing bobbins to said sewing machine, including means for guiding a lead bobbin carrier of said bobbin carriers into said bobbin housing;

means for holding said bobbin carriers; and means for positioning said lead bobbin carrier in register with said guiding means, said holding means comprising a magazine, adapted to be coupled to said frame of said sewing machine, having a first and a second end, and a longitudinal channel therethrough for containing a queue of said bobbin carriers, said guiding means comprising an opening disposed laterally through said first end of said magazine; and said positioning means including:

a plunger, operatively disposed in said channel so that said queue of bobbin carriers lies between said plunger and said first end, said plunger being removable from said second end of said magazine; and means, coupled to said plunger, for urging said plunger towards said first end of said magazine;

means, adapted to be coupled to said frame, and coupled to said bobbin carrier supplying means, for moving said bobbin carrier supplying means between a first position wherein said guiding means is aligned with said bobbin housing and a second position wherein said bobbin carrier supplying means is clear of said bobbin housing; and means, adapted to be coupled to said frame, for removing spent bobbins and corresponding bobbin carriers from said bobbin housing, and for positioning said bobbin carriers from said bobbin carrier supplying means in said bobbin housing, said bobbin carrier removing and positioning means comprising:

a pneumatic cylinder, adapted to be affixed to said frame of said sewing machine, having a rod movably disposed therein, said rod being alternately extendable from and retractable into said pneumatic cylinder in response to pneumatic pressure; and an electromagnet, coupled to an end of said rod projecting from said pneumatic cylinder so that when said bobbin carrier supplying means is in said second position clear of said bobbin housing said electromagnet is movable between a third position proximate said bobbin housing and a fourth position removed from said bobbin housing, said electromagnet being energizable to remove a first bobin carrier from said bobbin housing when in said third position, and being deenergizable to release said first bobbin carrier when moving from said third to said fourth position, said fourth position of said electromagnet being disposed so that when said bobbin carrier supplying means is in said first position wherein said guiding means is aligned with said bobbin housing, said guiding means is disposed between said bobbin housing and said electromagnet, said electromagnet being movable to said third position proximate said bobbin housing in cooperation with said guiding means, pushing said lead bobbin carrier into said bobbin housing in so moving, and being movable from said third to said fourth position in cooperation with said guiding means, leaving said lead bobbin carrier in said bobbin housing while so moving.

12. An apparatus as in claim 11 wherein said moving means comprises a pneumatic cylinder, adapted to be affixed to said frame of said sewing machine, having a rod movably disposed therein, said rod being alternately extendable from and retractable into said pneumatic cylinder in response to pneumatic pressure, an end of said rod projecting from said cylinder being coupled to said magazine.

13. An apparatus for changing bobbins and bobbin carriers in a sewing machine having a bobbin housing and a frame, comprising:

means, adapted to be coupled to said frame of said sewing machine, for supplying bobbin carriers containing bobbins to said sewing machine, including means for guiding a lead bobbin carrier of said bobbin carriers into said bobbin housing;

means, adapted to be coupled to said frame, and coupled to said bobbin carrier supplying means, for moving said bobbin carrier supplying means between a first position wherein said guiding means is aligned with said bobbin housing and a second position wherein said bobbin carrier supplying means is clear of said bobbin housing;

means, adapted to be coupled to said frame, for removing spent bobbins and corresponding bobbin carriers from said bobbin housing, and for positioning said bobbin carriers from said bobbin carrier supplying means in said bobbin housing; and means, coupled to said apparatus, for automatically operating said apparatus, including:

means for supplying pneumatic pressure;

solenoid operated directional control valves, coupled to said pneumatic pressure supplying means, said moving means, and said bobbin carrier removing and positioning means;

means, adapted to be affixed to said frame, for sensing positions of said bobbin carrier supplying means and said bobbin carrier removing and positioning means;

means for supplying electrical energy, coupled to said bobbin carrier removing and positioning means; and, a computer, responsive to said position sensing means, coupled to said solenoid operated directional control valves, and said electrical energy supplying means, for regulating said solenoid operated directional control valves and said electrical energy supplying means.

* * * * *